US010627165B2

(12) United States Patent
Seo et al.

(10) Patent No.: US 10,627,165 B2
(45) Date of Patent: Apr. 21, 2020

(54) HEAT EXCHANGER

(71) Applicant: Samsung Electronics Co., Ltd., Gyeonggi-do (KR)

(72) Inventors: Kang Tae Seo, Suwon-si (KR); Jeung Ku Choi, Suwon-si (KR); Young Min Kim, Suwon-si (KR); Yong-Hwa Choi, Hwaseong-si (KR); Hayase Gaku, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/703,906

(22) Filed: Sep. 13, 2017

(65) Prior Publication Data

US 2018/0073809 A1 Mar. 15, 2018

(30) Foreign Application Priority Data

Sep. 13, 2016 (KR) ..... 10-2016-0118201

(51) Int. Cl.
*F28D 1/053* (2006.01)
*F28F 1/12* (2006.01)
(Continued)

(52) U.S. Cl.
CPC ..... *F28D 1/05383* (2013.01); *F28D 1/0435* (2013.01); *F28F 1/128* (2013.01);
(Continued)

(58) Field of Classification Search
CPC ..... F28D 1/05383; F28D 1/05375; F28D 1/05366; F28D 1/05391; F28D 1/0443;
(Continued)

(56) References Cited

U.S. PATENT DOCUMENTS 5,529,116 A * 6/1996 Sasaki ..... F28D 1/0417 123/41.51
5,582,239 A * 12/1996 Tsunoda ..... B21D 53/02 165/176
(Continued)

FOREIGN PATENT DOCUMENTS

CN 1516799 A 7/2004
CN 1732366 A 2/2006
(Continued)

OTHER PUBLICATIONS

Office Action dated Sep. 19, 2019 in connection with Chinese Patent Application No. 201710821335.3, 23 pages.

*Primary Examiner* — Allen J Flanigan

(57) ABSTRACT

Disclosed herein is a heat exchanger, and more particularly to a heat exchanger having an improved refrigerant flow structure. The heat exchanger includes a plurality of tubes arranged in a first row and a second row, a first header connected to one end of the plurality of the first row tubes and a second header connected to one end of the plurality of the second row tubes, a first baffle dividing an inside of the first header into a first channel and a second channel in a vertical direction and dividing an inside of the second header into a third channel and a fourth channel in a vertical direction, an inlet pipe connected to the second channel to allow the refrigerant to flow therein, and an outlet pipe connected to the third channel to discharge the refrigerant.

20 Claims, 16 Drawing Sheets

(51) Int. Cl.
*F28F 19/00* (2006.01)
*F28F 9/02* (2006.01)
*F28D 1/04* (2006.01)

(52) U.S. Cl.
CPC ..... *F28F 9/0278* (2013.01); *F28F 19/00* (2013.01); *F28F 2235/00* (2013.01); *F28F 2275/04* (2013.01)

(58) Field of Classification Search
CPC .. F28F 1/32; F28F 1/325; F28F 9/0202; F28F 9/0204; F28F 9/0207; F28F 9/026; F28F 9/0265; F28F 9/0268; F28F 9/028; F28F 9/0278
See application file for complete search history.

(56) References Cited

U.S. PATENT DOCUMENTS

2004/0159121 A1* 8/2004 Horiuchi et al. ..... F25B 39/02 62/526
2006/0070726 A1* 4/2006 Yoshioka ..... F28F 1/128 165/151
2006/0236717 A1* 10/2006 Huang ..... F25B 39/04 62/513
2007/0199686 A1* 8/2007 Okinotani ..... F28D 1/05383 165/152
2008/0023185 A1* 1/2008 Beamer ..... F28D 1/05375 165/174
2009/0151918 A1* 6/2009 Hur ..... F28D 1/05391 165/173
2010/0206535 A1* 8/2010 Munoz ..... F25B 39/028 165/173
2011/0030935 A1* 2/2011 Riondet ..... F28D 1/0443 165/173
2012/0011867 A1* 1/2012 Koons ..... F25B 39/04 62/115
2015/0053383 A1* 2/2015 Citti ..... F28F 9/0212 165/173
2015/0226498 A1 8/2015 Park et al.
2017/0138675 A1 5/2017 Lu et al.

FOREIGN PATENT DOCUMENTS

CN 1849495 A 10/2006
CN 101029807 A 9/2007
CN 100412493 C 8/2008
CN 100541108 C 9/2009
CN 103983126 A 8/2014
CN 204006814 U 12/2014
CN 204115304 U 1/2015
CN 104422331 A 3/2015
CN 104833136 A 8/2015
JP 2007232246 A 9/2007
JP 2016102592 A 6/2016
KR 1020130077760 7/2013
KR 1020130081357 7/2013
KR 1020140010863 1/2014
KR 1020140068195 6/2014

* cited by examiner

HEAT EXCHANGER

CROSS-REFERENCE TO RELATED APPLICATION AND CLAIM OF PRIORITY

This application claims the benefit of Korean Patent Application No. 10-2016-0118201, filed on Sep. 13, 2016 in the Korean Intellectual Property Office, the disclosure of which is incorporated herein by reference.

TECHNICAL FIELD

Embodiments of the present disclosure relates to a heat exchanger, and more particularly to a heat exchanger having an improved refrigerant flow structure.

BACKGROUND

Generally, a heat exchanger includes a tube in which a refrigerant flows and a heat exchanges with outside air, a heat exchanger fin in contact with the tube to widen a heat dissipation area, and a header in which both ends of the tube are communicated, and an evaporator or a condenser. The heat exchanger may constitute a refrigeration cycle together with a compressor for compressing the refrigerant and an expansion valve for expanding the refrigerant.

The refrigerant flows through the header and then through the header to the heat exchanger. The refrigerant may be heat-exchanged with the outside air while flowing inside the tube. At this time, as the refrigerant flows inside the tube, the amount of heat exchange increases as the refrigerant contacts with a large amount of outside air, thereby increasing the efficiency of the heat exchanger.

SUMMARY

One aspect of the present disclosure provides a heat exchanger having an improved heat exchange performance by allowing refrigerant to flow evenly to a tube and by optimizing a refrigerant flow path.

Another aspect of the present disclosure provides a heat exchanger having improved heat exchange performance by delaying the growth in frost formed on a heat exchanger fin.

In accordance with one aspect of the present disclosure, a heat exchanger includes a plurality of tubes arranged in a first row and a second row, a first header connected to one end of the plurality of the first row tubes and a second header connected to one end of the plurality of the second row tubes, a first baffle dividing an inside of the first header into a first channel and a second channel in a vertical direction and dividing an inside of the second header into a third channel and a fourth channel in a vertical direction, an inlet pipe connected to the second channel to allow the refrigerant to flow therein, and an outlet pipe connected to the third channel to discharge the refrigerant.

The plurality of tubes in the first row includes a first area and a second area that are vertically partitioned through the first baffle and have opposite refrigerant flow directions, the plurality of tubes in the second row include a third area and a fourth area that are vertically partitioned through the first baffle and have opposite refrigerant flow directions, and the second area connected to the second channel and the fourth area connected to the fourth channel have the same refrigerant flow direction.

The heat exchanger may further include a third header connected to the opposite end of the plurality of the first row tubes, a fourth header connected to the opposite end of the plurality of the second row tubes, and a second baffle dividing an inside of the third header into a fifth channel and a sixth channel in the vertical direction and dividing an inside of the fourth header into a seventh channel and an eighth channel in the vertical direction.

The refrigerant flowing into the first header through the inlet pipe may flow to the third header sequentially through the second channel, the first area and the sixth channel, and flows upward from the sixth channel and flows back to the first header sequentially through the fifth channel, the second area and the first channel.

The heat exchanger may further include a connecting pipe connecting the first channel and the fourth channel, and the refrigerant in the first channel may flow into the fourth channel through the connecting pipe.

The refrigerant flowing into the second header through the connecting pipe may flow through the fourth channel, the fourth area, and the eighth channel sequentially to the fourth header, and flows upward from the eighth channel, and flows back through the seventh channel, the third area, and the third channel sequentially to the second header, and then flows to the outlet pipe.

The heat exchanger further includes a first distribution member distributing the refrigerant, and dividing an inside of the second channel into a first refrigerant distribution portion and a first refrigerant introduction portion, a second distribution member for dividing an inside of the fifth channel into a second refrigerant distribution portion and a second refrigerant introduction portion, a third distribution member for dividing an inside of the sixth channel into a third refrigerant distribution portion and a third refrigerant introduction portion, and a fourth distribution member for dividing an inside of the seventh channel into a fourth refrigerant distribution portion and a fourth refrigerant introduction portion.

A cross-sectional area ratio of the first refrigerant distribution portion and the second channel in the upward and downward direction is in the range of 35% to 45%.

The first distribution member may include two or more distribution holes allowing the refrigerant to flow from the first refrigerant distribution portion to the first refrigerant introduction portion, and a ratio of a value of total amount of cross-sectional area of the distribution hole in the forward and backward direction and a ratio of a value of total amount of cross-sectional area of the second channel in the upward and downward direction is in the range of 20% to 40%.

The second baffle may be configured to respectively divide the third header and the fourth header such that the fifth channel communicates with the sixth channel inside of the third header and the seventh channel communicates with the eighth channel inside of the fourth header.

The first distribution member may include a distribution portion extending in the longitudinal direction of the second channel and a support portion provided at both ends of the distribution portion and extending in the left-right direction of the second channel.

The heat exchanger may further include a heat exchanger fin having a body extending in the second row direction from the first row and disposed between the plurality of tubes to come into contact with the plurality of tubes, and the body may include a louver area in which a plurality of louvers projecting from the body is disposed and a plate area extending in the second row direction from the first row and having a flat surface.

The louver area may include a first louver area disposed above the plate area and a second louver area disposed below the flat plate area.

The plate area may include a first plate area disposed on the upper side of the louver area and a second plate area disposed on the lower side of the louver area.

A length of the louver area in the upward and downward direction is 65% or less of a length of the body in the upward and downward direction.

The body may include a first body and a second body disposed apart from each other in the extending direction of the plurality of tubes, and a ratio of a value of multiplying the distance between the first body and the second body by a length of the first body in the vertical direction and a value of cross-sectional area in the forward and backward direction of the heat exchanging fin of the first body may be less than 24%.

In accordance with another aspect of the present disclosure, a heat exchanger includes a plurality of tubes arranged in a first row and a second row, a pair of first headers connected to one end of the plurality of the first row tubes and one end of the plurality of the second row tubes respectively, wherein one of the pair of first headers is connected to a refrigerant inlet pipe and the other of the pair of first headers is connected to a refrigerant outlet pipe, a pair of second headers connected to the opposite end of the plurality of the first row tubes and the opposite end of the plurality of the second row tubes respectively, a first baffle dividing an inner space of the pair of the first header in a longitudinal direction of the pair of first headers, and a second baffle for dividing an inner space of the pair of second headers in the longitudinal direction of the pair of second headers.

The refrigerant flowing through the refrigerant inlet pipe flows into four areas divided in the plurality of tubes by the first and second baffles and then flows into the refrigerant outlet pipe, and four distribution members distributing the refrigerant flowing through the four areas are respectively mounted on four refrigerant introduction portions.

Two of the four distribution members disposed in the pair of first headers may be disposed below the first baffle and the other two distribution members disposed in the pair of second headers are disposed above the second baffle.

The pair of first headers may include a first front row header disposed at the first row of the plurality of tubes and a first rear row header disposed at the second row of the plurality of tubes, a connection pipe is disposed between the first front row header and the first rear row header, and the refrigerant having passed through two of the four areas arranged in the first row of the plurality of tubes passes through two of the four areas arranged in the second row of the plurality of tubes through the connecting pipe.

The heat exchanger may further include a pair of third baffles dividing the inside of the pair of first headers and respectively disposed on upper and lower sides of the first baffle, and a pair of fourth baffles dividing the inside of the pair of the second header and respectively disposed on the upper and lower sides of the first baffle.

The four distribution members may be respectively disposed in four spaces formed by the first baffle, the second baffle, the pair of the third baffles and the pair of the fourth baffles.

In accordance with another aspect of the present disclosure, a heat exchanger includes a plurality of tubes arranged in a first row and a second row, four headers respectively connected to both end of the first row and the second row of the plurality of tubes and extending in the vertical direction, two baffles dividing an inner space in the longitudinal direction of the four headers, and a heat exchanger fin having a body extending in the second row direction from the first row arranged between the plurality of tubes to come into to contact with the plurality of tubes.

The refrigerant may be redirected at least three times by the two baffles while flowing inside the plurality of tubes, and the body may include a louver area in which a plurality of louvers projecting on the body is disposed and a plate area extending in the second row direction from the first row at a central portion of the louver area and having a flat surface.

BRIEF DESCRIPTION OF THE DRAWINGS

These and/or other aspects of the disclosure will become apparent and more readily appreciated from the following description of the embodiments, taken in conjunction with the accompanying drawings of which

DETAILED DESCRIPTION

Figure 1:
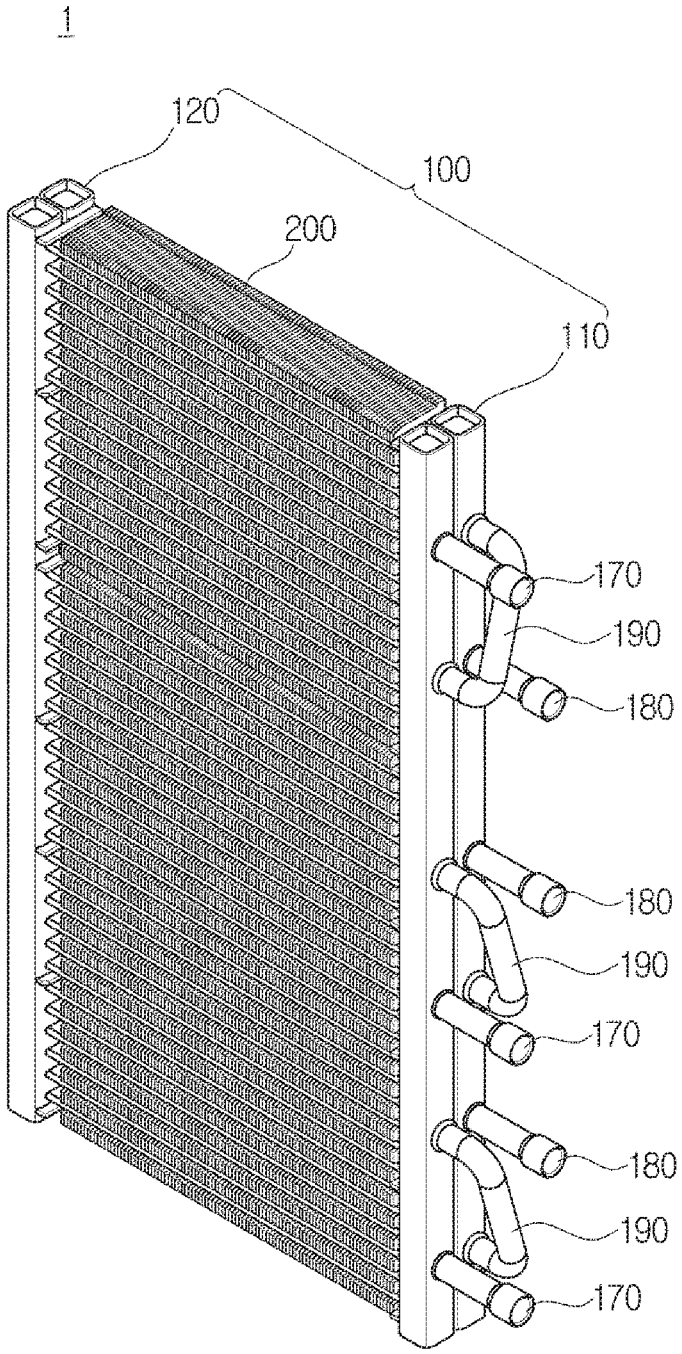
FIG. 1 is a perspective view of a heat exchanger according to an embodiment of the present disclosure.

Embodiments described in this specification and configurations illustrated in drawings are only exemplary examples of the disclosed disclosure. The disclosure covers various modifications that may be substituted for the embodiments and drawings herein at the time of filing of this application.

In addition, the same reference numerals or symbols refer to parts or elements that perform substantially the same function.

In addition, terms used in the present specification are merely used to describe exemplary embodiments and are not intended to limit and/or restrict the embodiments. An expression used in the singular encompasses the expression of the plural unless it has a clearly different meaning in context. In the present specification, the terms such as "including," "having," and "comprising" are intended to indicate the presence of the features, numbers, steps, actions, elements, parts, or combinations thereof disclosed in the specification, and are not intended to preclude the possibility that one or more other features, numbers, steps, actions, elements, parts, or combinations thereof may be present or added.

In addition, it should be understood that although the terms "first," "second," etc. may be used herein to describe various elements, the elements should not be limited by these terms. These terms are only used to distinguish one element from another. For example, a first element could be termed a second element, and, similarly, a second element could be termed a first element without departing from the scope of the present disclosure. As used herein, the term "and/or" includes any and all combinations of one or more of the associated listed items.

Hereinafter, the upper and upward used in the following description refer to upper and upward directions seen upward from the heat exchanger 1 shown in FIG. 1, and lower and downward refer to directions toward the lower of the outdoor unit of the air conditioner.

The front and forward used in the following description refer to front direction seen forward from the heat exchanger 1 shown in FIG. 1, and rear and backward refer to directions toward the rear direction seen backward from the heat exchanger 1 not shown in FIG. 1.

Hereinafter, embodiments of the present disclosure will be described with reference to the accompanying drawings in detail.

Figure 2:
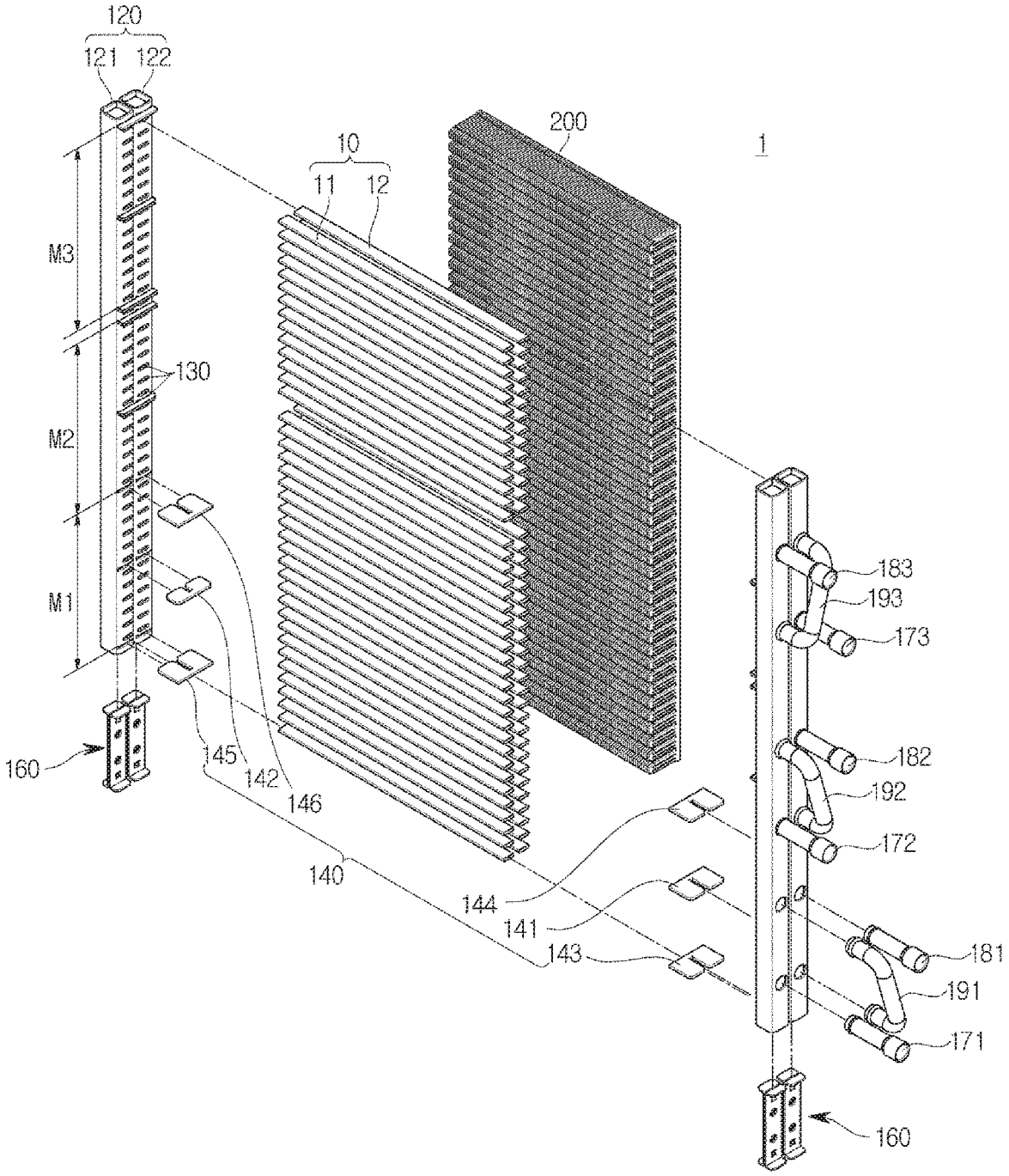
FIG. 2 is an exploded perspective view of the heat exchanger according to an embodiment of the present disclosure.

As shown in FIGS. 1 and 2, the heat exchanger 1 according to an embodiment of the present disclosure may include a plurality of tubes 10, in which refrigerant flows and heat-exchanges with outside air, a heat exchanger fin 200 contacting the plurality of tubes 10 and a header 100 communicating with both ends of the plurality of tubes 10 and supporting the plurality of tubes 10.

The plurality of tubes 10 may be arranged in two rows, a front row and a rear row. In other words, the plurality of tubes 10 are divided into a plurality of first row tubes 11 disposed in a first heat transferring row and a plurality of second row tubes 12 disposed in a second heat transferring row. The plurality of tubes 11 and 12 may be horizontally arranged so as to be spaced apart from each other by a predetermined distance in the vertical direction. However, the present disclosure is not limited to this embodiment, and the plurality of tubes may include three rows and one or more rows.

The plurality of tubes 10 may have a flat shape. That is, the plurality of tubes 10 may have a top surface and a bottom surface that are flat in the up-and-down direction and have rounded surfaces connecting the top surface and the bottom surface. Although not shown, a plurality of micro-tubes may be provided inside the flat shape, and the refrigerant may flow through the plurality of tubes 10 through the plurality of micro-tubes.

The header 100 may be provided at both ends of the plurality of tubes 10 and particularly, two headers 100 may be disposed in the lateral direction so as to communicate with both ends of the plurality of tubes 10. That is, the header 100 may include a first header 110 disposed on the right side and a second header 120 disposed on the left side.

The first header 110 also may include a first front row header 111 communicating with one end of the plurality of tubes in the first row 11 and a first rear row header 112 communicating with one end of the plurality of tubes in the second row 12. The second header 120 may include a second front row header 121 communicating with the other end of the plurality of tubes in the first row 11 and a second rear row header 121 communicating with the other end of the plurality of tubes in the second row 12.

That is, the header 100 may be composed of a total of four headers. Hereinafter, the first front row header 111 is referred to as a first header 111, the first rear row header 112 is referred to as a second header 112, the second front row header 121 is referred to as a third header 121, and the second rear row header 122 is referred to as a fourth header 122.

In describing the overlapping features of the four headers 111, 112, 121 and 122, four headers 111, 112, 121 and 122 will be collectively referred to as a header 100. In describing the first and second headers 111 and 112, and the third and fourth headers 121 and 122 will be collectively referred to as a right header 110 and a left header 120.

The header 100 may include a plurality of connection holes 130 through which the plurality of tubes 10 are inserted and connected. The connection hole 130 may be provided so as to correspond to the size of the outer circumference of the plurality of tubes 10 so that the plurality of tubes 10 can be partially inserted into the header 100. The plurality of connection holes 130 may be spaced apart in the vertical direction of the header 100 in correspondence with the plurality of tubes 10 arranged in the vertical direction.

The first header 111 may be provided with an inlet pipe 170 to allow the refrigerant to flow into the heat exchanger 1. The refrigerant flowing through the inlet pipe 170 flows to the plurality of tubes 10 through the first header 110 and heat-exchanged with the outside air. The characteristics of the refrigerant flowing will be described later in detail.

The second header 112 may be provided with an outlet pipe 180 to allow the refrigerant to flow out of the heat exchanger 1. The refrigerant flows from the second header 112 to the outlet pipe 180 and flows out of the heat exchanger 1. The process of discharging the refrigerant will be described later in detail.

A connecting pipe 190 may be provided between the first header 111 and the second header 112 to allow the refrigerant introduced into the first header 111 to flow through the second header 112. The refrigerant may flow into the first header 111 through the plurality of tubes 11 in the first row and may flow into the second header 112 through the connecting pipe 190. This will be described in detail later.

The inlet pipe 170, the outlet pipe 180, and the connecting pipe 190 may be connected to the first header 111 and the second header 112, respectively. That is, with respect to the lower side, a first inlet pipe 171, a first outlet pipe 181 and a first connecting pipe 191, a second inlet pipe 172, a second outlet pipe 182, and a second connecting pipe 192 and a third inlet pipe 173, a third outlet pipe 183, and a third connecting pipe 193 may be provided.

One of the inlet pipe 170, the outlet pipe 180 and the connecting pipe 190 may form one refrigerant flow path. That is, the first inlet pipe 171, the first outlet pipe 181 and the first connecting pipe 191 may form a first flow path, and the second inlet pipe 172, the second outlet pipe 182, and the second connecting pipe 192 may form a second flow path, and the third inlet pipe 173, the third outlet pipe 183 and the third connecting pipe 193 may form a third flow path.

The inside of the header 100 may be divided by a baffle 140 to be described later, and thus different flow paths may be formed in the header 100, respectively. That is, the heat exchanger 1 has three separate flow paths (refrigerant channels), and heat exchange of the refrigerant may be performed separately for each flow path.

In the heat exchanger 1, a side where the first flow path is formed is referred to as a first module M1, a side where the second flow path is formed is referred to as a second module M2, and a side where the third flow path is formed is referred to as a third module M3. However, the present disclosure is not limited to the embodiment. Depending on the number of the inlet pipe 170, the outlet pipe 180, and the connecting pipe 190, more or fewer flow path may be formed.

As described above, each of the modules M1, M2, and M3 may be divided by the baffle 140 that divides the flow path. Each of the modules M1, M2, and M3 is provided in the same form, so only one module M1 will be described.

The inner space of the header 100 may be partitioned by the baffle 140. The inner space of the right header 110 may be partitioned by a first baffle 141 and the inner space of the left header 120 may be partitioned by a second baffle 142.

The baffle 140 may be provided in plurality so as to partition the inner space of the header 100 in the vertical direction of the first and second baffles 141 and 142 in addition to the first and second baffles 141 and 142. That is, the baffle 140 may further include four baffles 143, 144, 145, and 146 to seal the vertical direction of the header 100 in the module.

In detail, a third baffle 143 for sealing the lower portion of the first and second headers 111 and 112 may be disposed below the first baffle 141 to seal the inner space of the first and second headers 111 and 112 from the outside, and a fourth baffle 144 may be disposed on the upper side of the first baffle 141 to divide the first module M1 and the second module M2 in the first and second headers 111 and 112.

A fifth baffle 145 for sealing the lower portions of the third and fourth headers 121 and 122 may be disposed below the second baffle 142 to seal the inner spaces of the third and fourth headers 121 and 122 from the outside, and a sixth baffle 146 may be disposed on the upper side of the baffle 142 to divide the first module M1 and the second module M2 in the third and fourth headers 121 and 122.

The third baffle 143 and the fifth baffle 145 may form a lower flow path of the first module M1 and the fourth baffle 144 and the sixth baffle 146 may form an upper flow path of the first module M1. However, with respect to the second module M2, the fourth baffle 144 and the sixth baffle 146 may form the lower flow path of the second module M2.

Hereinafter, the flow of the refrigerant in the first module M1 will be described in detail. The flow of the refrigerant in the first module M1 is the same as the flow of the refrigerant in the second and third modules M2 and M3 and thus the description of the flow of the refrigerant in the second and third modules M2 and M3 will be omitted.

As shown in FIGS. 3 to 7, the first module M1 may be disposed in a portion of the space partitioned by the plurality of baffles 140 in the first to fourth headers 111, 112, 121 and 122.

Figure 3:
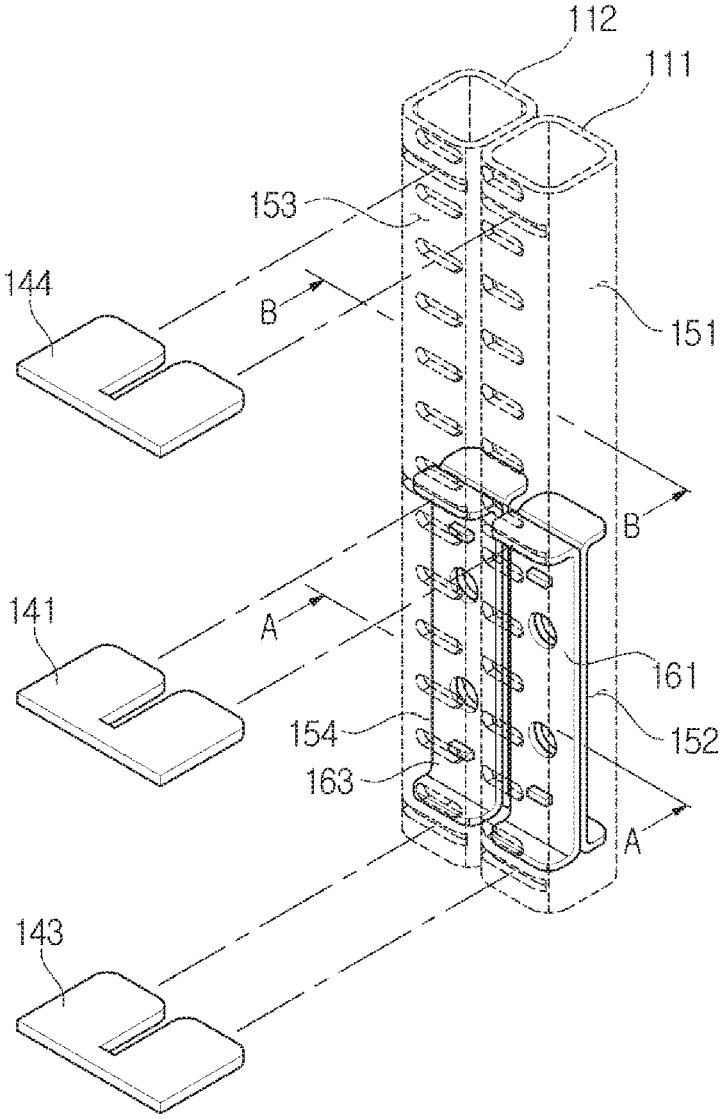
FIG. 3 is an exploded perspective view of a part of a right header of the heat exchanger according to an embodiment of the present disclosure.

As shown in FIG. 3, the first header 111 may be partitioned into two inner spaces by the first baffle 141. That is, a first channel 151 may be formed above the first baffle 141, and a second channel 152 may be formed below the first baffle 141. A third channel 153 may be formed on the upper side of the first baffle 141 and a fourth channel 154 may be formed on the lower side of the first baffle 141 In the second header 112.

Figure 4:
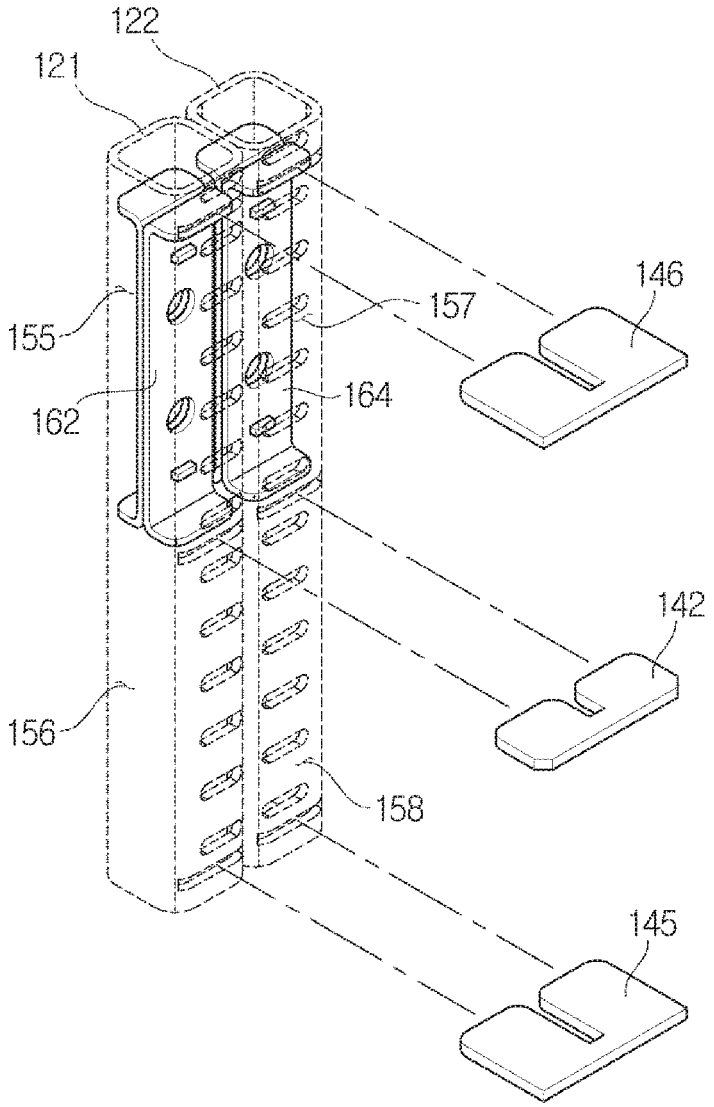
FIG. 4 is an exploded perspective view of a part of a left header of a heat exchanger according to an embodiment of the present disclosure.

As shown in FIG. 4, the third header 121 may be divided into two inner spaces by the second baffle 142. A fifth channel 155 may be formed above the second baffle 142 and a sixth channel 156 may be formed below the second baffle 142. A seventh channel 157 may be formed on the upper side of the second baffle 142 and an eighth channel 158 may be formed on the lower side of the second baffle 142 in the fourth header 122.

As shown in FIGS. 3 and 4, the first channel 151 and the third channel may be formed between the first baffle 141 and the fifth baffle 145, respectively, the second channel 152 and the fourth channel may be formed between the first baffle 141 and the third baffle 143, respectively, the fifth channel 155 and the seventh channel 157 may be formed between the second baffle 142 and the sixth baffle 146, respectively, and the sixth channel 156 and the eighth channel 158 may be formed by the second baffle 142 and the fourth baffle 144, respectively.

Figure 5:
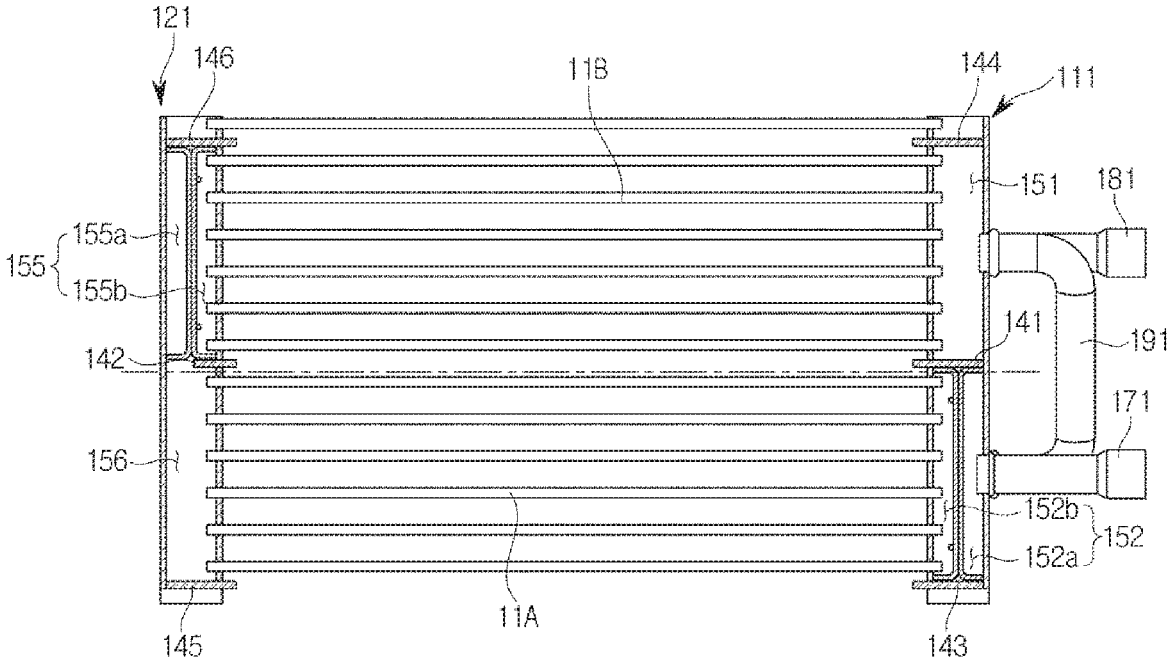
FIG. 5 is a cross-sectional view of a front row of the heat exchanger according to an embodiment of the present disclosure.
Figure 6:
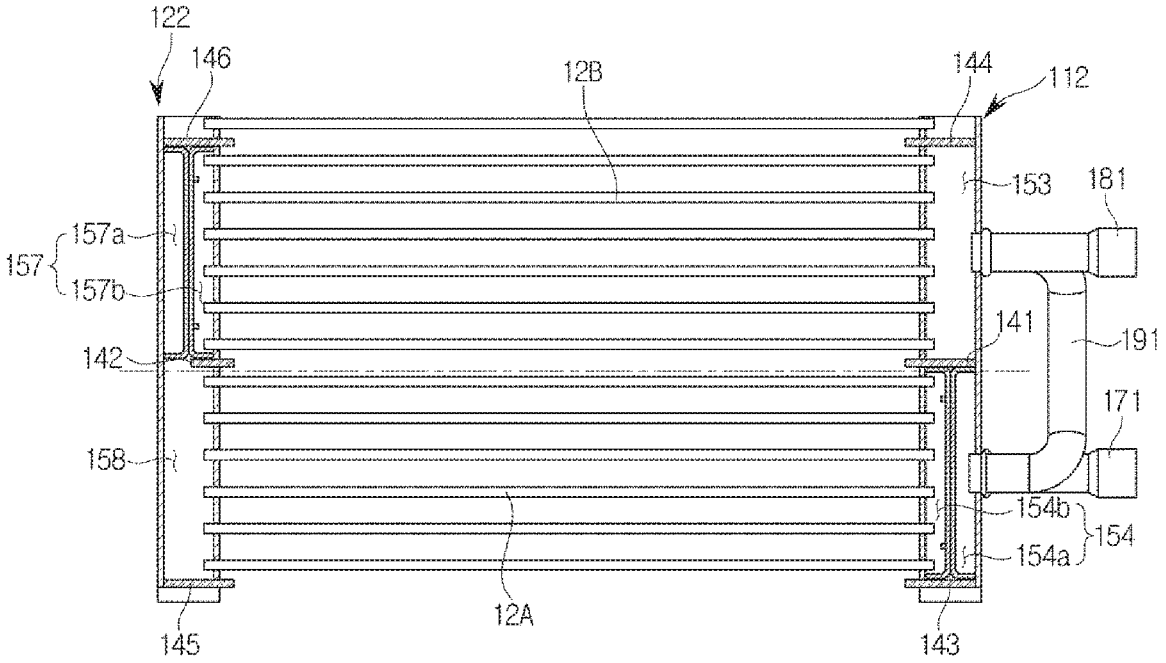
FIG. 6 is a cross-sectional view of a rear row of the heat exchanger according to an embodiment of the present disclosure.

As shown in FIGS. 5 and 6, the first inlet pipe 171 may be connected to the second channel 152 of the first header 110 and the first outlet pipe 181 may be connected to the third channel 153 of the second header 112. The first connection pipe 191 may be connected between the first channel 151 of the first header 111 and the fourth channel 154 of the second header 112.

As described above, the inner space of the header 100 is partitioned by the plurality of baffles 140, and each of the inner spaces may form the flow path through which the refrigerant flows. That is, the flow path for changing the direction of the refrigerant may be formed inside the header 100 through the plurality of baffles 140.

That is, as shown in FIG. 5, the refrigerant flowing into the first channel 111 through the first inlet pipe 171 may flow in the left direction to the plurality of tubes in the first row 11 without flowing to the upper side of the first channel 111 by the first baffle 141.

The refrigerant flowing along the plurality of tubes in the first row 11 may flow into the sixth channel 156 of the third header 121 and then directed upward to the fifth channel 155. As shown in FIGS. 2 and 4, the second baffle 142 has a short length extending in the left-right direction, unlike the other baffles 141, 143, 144, 145 and 146, and divides the inside of the header 100 without sealing.

Accordingly, a space is formed by the second baffle 142 and the third header 121 and disposed between the fifth channel 155 and the sixth channel 156, and the refrigerant may flow from the sixth channel 156 to the fifth channel 155 through the space between the fifth channel 155 and the sixth channel 156.

The refrigerant flowing into the fifth channel 155 may flow back to the plurality of tubes in the first row 11 and move to the first header 111 and then flow to the first channel 151.

The plurality of tubes in the first row 11 may include a flow path having an opposite flow in the up-and-down direction by the first baffle 141 and the second baffle 142 respectively. That is, in the plurality of tubes in the first row 11, a first area 11A in which the refrigerant flows from right to left may be formed on the side where the second channel 152 and the sixth channel 156 are connected to each other, and a second area 11B in which refrigerant flows from left to right may be formed on the side where the first channel 151 and the fifth channel 155 are connected to each other.

The first connecting pipe 191 is connected to the first channel 151 so that the refrigerant flowing into the first channel 151 flows through the first connecting pipe 191 to the fourth channel 154 of the second header 112, as illustrated in FIG. 6. The refrigerant flowing into the fourth channel 154 may flow toward the left to the plurality of tubes in the second row 12 without flowing upwardly by the first baffle 141.

The refrigerant flowing along the plurality of tubes in the second row 12 may flow into the eighth channel 158 of the fourth header 122 and then move upward toward the seventh channel 157. As described above, since the length of the second baffle 142 extending in the left-right direction is short, the second baffle 142 divides the header 100 without sealing inside of the header 100. So the refrigerant may flow from the eighth channel 158 to the seventh channel 157 through a gap formed between the seventh channel 157 and the eighth channel 158 by the second baffle 142. The refrigerant flowing into the seventh channel 157 may be moved to the second header 112 again through the plurality of tubes of the second row 12 and then flow to the third channel 153.

The plurality of tubes in the second row 12 may include a flow path having an opposite flow in the up and down directions by the first baffle 141 and the second baffle 142 respectively. That is, in the plurality of tubes in the second row 12, a third area 12A in which refrigerant flows from right to left may be formed on the side where the fourth channel 154 and the eighth channel 158 are connected to each other, and a fourth area 12B in which the refrigerant flows from the left to the right may be formed on the side where the third channel 153 and the seventh channel 157 are connected to each other. The refrigerant flowing into the third channel 153 may be discharged to the outside of the heat exchanger 1 through the first outlet pipe 181 provided in the third channel 153.

Figure 7:
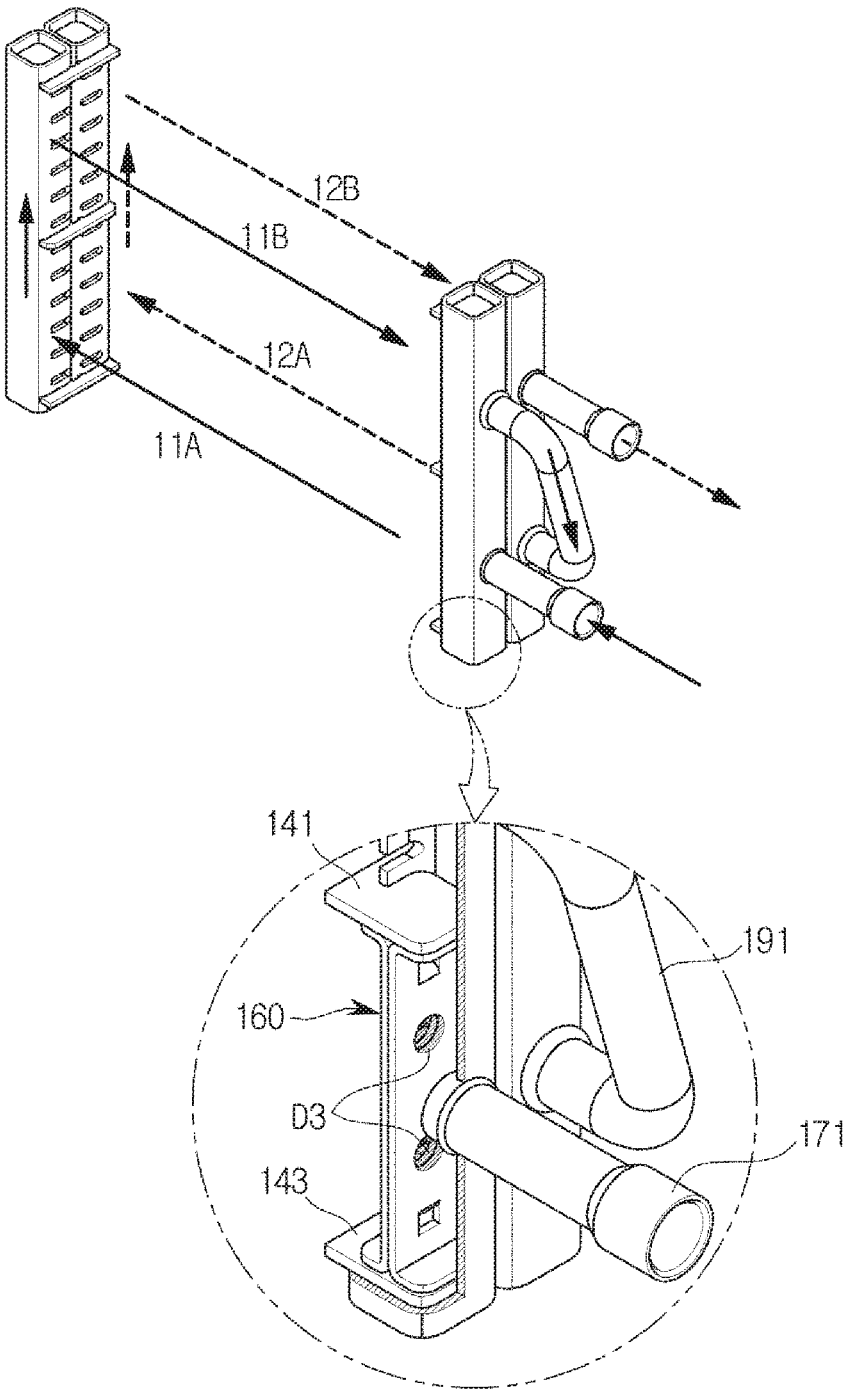
FIG. 7 is a schematic view of a refrigerant flow in one module of the heat exchanger according to an embodiment of the present disclosure.

As shown in FIG. 7, the refrigerant introduced into the heat exchanger 1 may flow through the tube 10 after the refrigerant flow direction changes four times through a total of three turns, and then discharged to the outside of the heat exchanger 1. That is, the plurality of tubes 10 are divided into four areas 11A, 11B, 12A, and 12B, and the refrigerant may be heat-exchanged with the outside air through three turns while passing through the respective areas 11A, 11B, 12A, and 12B.

The refrigerant may flow into the plurality of tubes in the first row 11 through the first inlet pipe 171 and flow inside of the plurality of tubes in the first row 11 through the first area 11A and the second area 11B, and then flow into the plurality of tubes of the second row 12 through the first connection pipe 191. Then the refrigerant may flow inside of the plurality of tubes in the second row 12 through the third area 12A and the fourth area 12B and then flow out of the heat exchanger 1 through the first outlet pipe 181.

The refrigerant may flow in the right header 110 and flow into the left header 120 through the plurality of tubes 10 and then move from the left header 120 to the right header 110 via the plurality of tubes 10. Since the inlet pipe 170 is connected to the first header 111 and the plurality of tubes in the first row 11 is connected to the second header 112 through the connecting pipe 190, the refrigerant flowing in the plurality of tubes of the first row 11 and the plurality of tubes of the second row 12 may flow in the same direction.

That is, the refrigerant in the first area 11A and the refrigerant in the third area 12A may flow in the same direction, and the refrigerant passing through the first area 11A and the third area 12A may flow through the third header 121, and then flow into the fourth header 122 and then flow upward through the second baffle 142 and pass through the second area 11B and the fourth area 12B to pass through the first header 111 and the second header 122.

The refrigerant flowing into the first header 111 to the third header 121 through the first inlet pipe 171 may flow through the second channel 152 and the first area 11A and the sixth channel 156 sequentially. And then the refrigerant may flow upward from the sixth channel 156 and flow back to the first header 111 sequentially through the fifth channel 155, the second area 11B and the first channel 151.

After that, the refrigerant in the first channel 151 may flow into the second header 112 along the first connecting pipe 191 and flow into the fourth channel 154 and the fourth area 12B and the eighth channel 158 sequentially to the fourth header 122. And then the refrigerant may flow upward in the eighth channel 158 to sequentially pass through the seventh channel 157, the third area 12A and the third channel 153, and flow back to the first outlet pipe 181 after flowing back to the second header 112.

The refrigerant may make three turns while sequentially passing through the four areas 11A, 11B, 12A, and 12B provided in the plurality of tubes 10 respectively. In other words, the refrigerant may flow in the same direction from the right side to the left side respectively on the lower side of the plurality of tubes in the first row 11 and the plurality of tubes in the second row 12, and the refrigerant may flow in the same direction from the left side to the right side respectively on the upper side of the plurality of tubes in the first row 11 and the plurality of tubes in the second row 12.

In the conventional heat exchanger, the refrigerant flows into a first row of a plurality of tubes through a first header provided on one side, and flows into a second row of the plurality of tubes through the other header provided on the other side, and then flows back to the header on one side which is the refrigerant exchanges heat with the outside air using a single turn.

That is, in the case of the conventional heat exchanger having two rows of tubes, the first row of the plurality of tubes and the second row of the plurality of tubes have the flow path in the opposite direction to each other, and thus the refrigerant has flowed out of the heat exchanger after one turn of flow from the header on both sides. When moving in the first row of the plurality of tubes, the refrigerant may flow only in one direction and when moving in the second row of the plurality of tubes, the refrigerant may flow only in another direction that is opposite to the one direction.

However, unlike the conventional heat exchanger, since the plurality of tubes 10 of the heat exchanger 1 according to the embodiment of the present disclosure includes four areas 11A, 11B, 12A, and 12B formed by flow paths in mutually opposite directions, the refrigerant flowing through the plurality of tubes 11 and 12 in the first and second rows may flow in one direction and the opposite direction in the plurality of tubes 11 and 12 in each rows without flowing in only one direction.

Accordingly, as a length of the flow path through which the refrigerant flows per one plurality of tubes becomes twice, a heat exchange area where the refrigerant and the outside air may heat-exchange may be increased. A heat exchange performance may be increased since the heat exchange area is larger than that of the conventional heat exchanger even when the same amount of refrigerant flows into the heat exchanger 1 as compared with the conventional heat exchanger.

Further, since the refrigerant flows twice as long as the extension length of the plurality of tubes 10 in the left-right direction, even if the extension length of the plurality of tubes 10 is reduced to be smaller than the extension length of the tube of the conventional heat exchanger, heat exchange performance may be maintained.

Thus, even if a space in which the heat exchanger 1 is disposed is narrow, the lengths of the tubes 10 may be set to be shorter than the lengths of the tubes of the conventional heat exchanger so that the heat exchanger 1 may be easily installed.

In the conventional heat exchanger, as described above, the refrigerant flows through the heat exchanger through one turn, and a distribution member is provided only on the inner side of one of the two headers to which the inlet pipe is connected, thereby uniformly distributing the refrigerant to the plurality of tubes. No distribution member is disposed on the left header where the inlet pipe is not disposed. When the plurality of tubes are provided in two rows as in the embodiment of the present disclosure, the header corresponding to the third header of the present disclosure does not require the distribution member because the refrigerant flows from the plurality of tubes to the header without flowing from the header to the plurality of tubes.

The heat exchanger 1 according to the embodiment of the present disclosure, since the refrigerant flows into the four headers 111, 112, 121, and 122 through the plurality of tubes, and the refrigerant is sprayed from the four headers 111, 112, 121 and 122 to the plurality of tubes 10 due to the three turns of the refrigerant in the heat exchanger 1, the distribution member 160 may be disposed in all of the four headers 111, 112, 121 and 122. That is, the distribution member 160 may be disposed on the side where the refrigerant flows into the plurality of tubes 10 in the header 100.

As shown in FIGS. 3 to 6, the distribution member 160 may include a first distribution member 161 disposed in the second channel 152 corresponding to an inlet of the first area 11A, a second distribution member 162 disposed in the fifth channel 155 corresponding to an inlet of the second area 11B, a third distribution member 163 disposed on the fourth channel 154 corresponding to the inlet of the third area 12A, and a fourth distribution member 164 disposed on the seventh channel 157 corresponding to the inlet of the fourth area 12B.

The first distribution member 161 may partition the inside of the second channel 152 into a first refrigerant distribution portion 152*a* and a first refrigerant introduction portion 152*b*, the second distribution member 162 may partition the inside of the fifth channel 155 into a second refrigerant distribution portion 155*a* and a second refrigerant introduction portion 155*b*, the third distribution member 163 may partition the inside of the fourth channel 154 into a third refrigerant distribution portion 154*a* and a third refrigerant introduction portion 154*b*, and the fourth distribution member 164 may partition the seventh channel 157 into a fourth refrigerant distribution portion 157*a* and a fourth refrigerant introduction portion 157*b*.

Four distribution members 161, 162, 163 and 164 are provided at the introduction portions of the respective areas 11A, 11B, 12A and 12B where the refrigerant introduce into the four areas 11A, 11B, 12A and 12B, and thus the refrigerant may be distributed evenly to each of the tubes.

When refrigerant flows into the refrigerant distribution portions 152*a*, 154*a*, 155*a* and 157*a* respectively formed in the channels 152, 154, 155 and 157 by the distribution members 161, 162, 163 and 164, the refrigerant may be mixed and stabilized in the inside of the refrigerant distribution portions 152*a*, 154*a*, 155*a* and 157*a* before being distributed to into the refrigerant introduction portions 152*b*, 154*b*, 155*b*. The refrigerant may be introduced into the refrigerant introduction portions 152*b*, 154*b*, 155*b* and 157*b* and then introduced into the plurality of tubes 10.

In detail, the refrigerant introduced into the second channel 152 through the inlet pipe 171 is introduced to the first refrigerant distribution portion 152*a* formed at one side of the inside of the second channel 152 and divided by the first distribution member 161. The refrigerant is distributed to the first refrigerant introduction portion 152*b* through a distribution hole 165 provided in the first distribution member 161 and then the refrigerant may flow to the first area 11A of the plurality of tubes in the first row 11.

The refrigerant that has passed through the first area 11A may flow into the sixth channel 156 and flows into the sixth channel 156 through the space formed between the second baffle 142 and the inner space of the third header 121, and then the refrigerant may be moved to the fifth channel 155.

The refrigerant introduced into the fifth channel 155 may be introduced into the second refrigerant distribution portion 155*a* formed on one side of the fifth channel 155 and partitioned by the second distributor member 162. The refrigerant may be distributed to the second refrigerant introduction portion 155*b* through the distribution hole 165 provided in the second distribution member 162 and then flow into the second area 11B of the plurality of tubes in the first row 11.

The refrigerant that has passed through the second area 11B may flow into the first channel 151 and flow from the first header 111 to the second header 112 through the first connection pipe 191, in detail, flowing to the fourth channel 154.

The refrigerant flowing into the fourth channel 154 may be introduced into the third refrigerant distribution portion 154*a* formed on one side of the fourth channel 154 and partitioned by the third distribution member 163. The refrigerant may be distributed to the third refrigerant introduction portion 154*b* through the distribution hole 165 provided in the third distribution member 163 and then moved to the third area 12A of the plurality of tubes in the second row 12.

The refrigerant having passed through the third area 12A may flow into the eighth channel 158. The refrigerant may flow from the eighth channel 158 to the seventh channel 157 through the space formed between the second baffle 142 and the inner space of the fourth header 122.

The refrigerant introduced into the seventh channel 157 may be introduced into the fourth refrigerant distribution portion 157*a* formed at one side of the seventh channel 157 and partitioned by the fourth distribution member 164. The refrigerant may be distributed to the second refrigerant introduction portion 157*b* through the distribution hole 165 provided in the fourth distribution member 164 and then moved to the second area 12B of the plurality of tubes in the second row 12. The refrigerant having passed through the fourth area 12B may flow into the third channel 153 and flow out of the heat exchanger 1 along the first outlet pipe 181 connected to the third channel 153.

That is, while circulating the first module M1 of the heat exchanger 1 the refrigerant flows through four areas 11A, 11B, 12A, and 12B partitioned in the inside of the plurality of tubes 10, wherein the refrigerant passes along the four distribution members 161, 162, 163, and 164 disposed on the side of the introduction portion, before flowing into the four areas 11A, 11B, 12A, and 12B. Therefore, the refrigerant flowing into each tube may be introduced in a uniform amount and it may prevent that a large amount of the refrigerant is concentrated on one side. Accordingly, the heat exchange performance may be improved, and the increase in refrigerant resistance can be minimized because the refrigerant flows evenly.

Hereinafter, the feature of the distribution member 160 and the feature of a method in which the distribution member 160 are fixed within the header 100 will be described.

Figure 8:
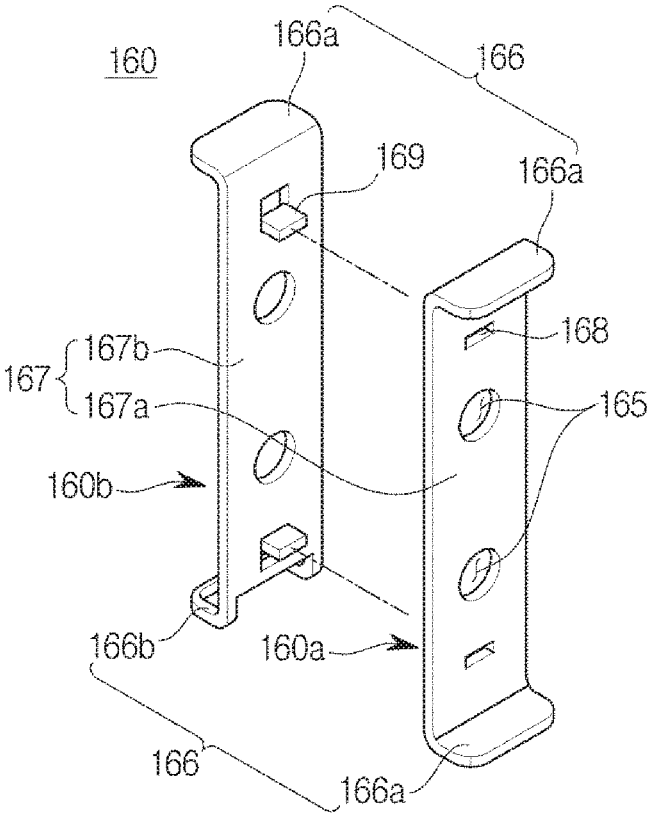
FIG. 8 is an exploded perspective view of a distribution member of the heat exchanger according to an embodiment of the present disclosure.

As shown in FIGS. 7 and 8, the distribution member 160 may be inserted into the inner space of the header 100 to serve as a partition for partitioning the inner space of the header 100. In detail, the distribution member 160 may be provided such that the inner space of the header 100 is partitioned in the left-right direction.

The distribution member 160 may include a distributor 167 configured to serve as a partition wall in the header 100 to divide the refrigerant temporarily in the header 100 and the distribution hole 165 disposed on the distributor 167 to distribute the refrigerant by allowing the refrigerant to pass therethrough.

The distributor 167 may extend in the direction corresponding to the longitudinal direction of the header 100 and may be provided in the shape of a surface facing the left and right direction of the heat exchanger 1.

Two distribution holes 165 may be disposed in the distributor 167. However, the present disclosure is not limited to this embodiment, and the distribution holes 165 may be formed as one or three or more. This will be described in detail later.

On upper and lower sides of the distributor 167, a supporter 116 extending in the left-right direction of the heat exchanger 1 may be respectively provided. The supporter 116 is provided so that the distribution member 160 may be fixed within the header 100.

In detail, the distribution member 160 may be provided inside of the channels 152, 153, 156, 157 of the header 100 defined by the baffle 140. As shown in FIG. 3, the first distribution member 161 is disposed in the second channel 152 and the third distribution member 163 is disposed in the fourth channel 154, and each of the distribution members 161 and 163 may be supported by the third baffle 143 on the lower side and the first baffle 141 on the upper side.

That is, a distributor 167 of the first distribution member 161 and a distributor 167 of the third distribution member 163 may extend to a length corresponding to the length between the first baffle 141 and the third baffle 143, and the supporter 166 disposed at the upper and lower ends of the distributor 167 may be provided to abut the lower end of the first baffle 141 and the upper end of the third baffle 143.

The first distribution member 161 and the third distribution member 163 may be inserted at one end of the first header 111 and the second header 112 and disposed inside the respective headers 111 and 112. The first and third distribution members 161 and 163 may be disposed on the side corresponding to the second channel 152 and the fourth channel 154, respectively. On the upper side of the first header 111 and the second header 112, the first baffle 141 is inserted and on the lower side thereof, the third baffle 143 is inserted. Therefore, the upper and lower sides of the channels 152 and 154 are sealed, and the first and third distribution members 161 and 163 disposed inside the channels 152 and 154 respectively may be fixed by the third baffle 143 and the first baffle 141. Then, the headers 111 and 112, the baffles 141 and 143, and the distribution members 161 and 163 may be integrally formed through brazing.

As shown in FIG. 4, the second distribution member 162 is disposed in the fifth channel 155, the fourth distribution member 164 is disposed inside the seventh channel 157, and each of the distribution members 162 and 164 may be supported by the second baffle 142 downwardly and the sixth baffle 146 upwardly.

The distributor 167 of the second distribution member 162 and the distributor 167 of the fourth distribution member 164 may extend to a length corresponding to the length between the second baffle 142 and the sixth baffle 146, and the supporter 166 disposed at the upper and lower ends of the distributor 167 may be provided to abut the upper end of the second baffle 142 and the lower end of the sixth baffle 146.

The second distribution member 162 and the fourth distribution member 164 may be inserted at the ends of the third header 121 and the fourth header 122 and disposed inside the respective headers 121 and 122. The second and fourth distribution members 162 and 164 may be disposed on the side corresponding to the fifth channel 155 and the seventh channel 157 respectively. On the upper side of the third header 121 and the fourth header 122, the second baffle 142 is inserted and on the lower side thereof, the sixth baffle 146 is inserted. Therefore, the upper side of each channel 155, and 157 may be sealed, and a predetermined distance may be formed between the second baffle 142 and the inside of the third and fourth headers 121 and 122. The upper supporters 166 of the second and fourth distribution members 162 and 164 may be arranged to be in contact with the total area of the lower end of the sixth baffle 146, and the lower supporters 166 of the second and fourth distribution members 162 and 164 may be disposed in contact with the some area of the upper end of the second baffle 162. Then, the headers 121 and 122, the baffles 142 and 146, and the distribution members 162 and 164 may be integrally formed through brazing.

The length of the distributor 167 is not limited thereto. The length of the distributor 167 in the up and down direction may be smaller than the length of each of the channels 152, 514, 515, 157 in the vertical direction, so that the supporters 166 to be disposed on the upper and lower sides of the distributor 167 may not contact the respective baffles 141, 142, 143, and 146 disposed on the upper and lower sides of the supporters 166. At this time, however, the header 100, the baffle 140, and the distribution member 160 may be integrally brazed after the processing.

The distribution member 160 may be inserted into the header 100 through one opened end of the header 100 and then provided between and fixed to the baffles 140 which are inserted at regular intervals in the vertical direction. The first distribution member 161 inserted into the first header 111 and the third distribution member 163 inserted into the second header 112 are disposed below the first baffle 141 and above the third baffle 143, and the second distribution member 162 inserted into the third header 121 and the fourth distribution member 164 inserted into the fourth header 122 are disposed between the upper side of the second baffle 142, and the lower side of the sixth baffle 146.

As shown in FIG. 8, the distribution member 160 may be formed by coupling a first member 160*a* and a second member 160*b*. The first member 160*a* and the second member 160*b* may be symmetrically formed and may include first and second distributor 167*a* and 167*b* and first and second supporter 166*a* and 166*b*.

The distribution holes 165 of the first member 160*a* and the second member 160*b* may be formed at the same height in the vertical direction so that a single distribution hole 165 may be formed when the first member 160*a* and the second member 160*b* are coupled.

The second member 160*b* may include a coupling protrusion 169 protruding from the second distributor 167*b* in a direction with which the first member 160*a* is engaged, and the first member 160*a* may include a coupling groove 168 provided at a position corresponding to the coupling protrusion 169. The first member 160*a* and the second member 160*b* are coupled with each other while the coupling protrusions 169 are coupled to the coupling grooves 168 and then brazed together when the header 100 is brazed.

The configuration of the distribution member 160 is not limited thereto. The distribution member 160 may be provided in one configuration. However, when the distribution member 160 is provided as the first member 160*a* and the second member 160*b* as in the embodiment of the present disclosure, the distribution member 160 may be easily processed by bending the flat plate materials corresponding to the respective members 160*a* and 160*b*, and coupling the first member 160*a* to the second member 160*b*.

The supporter 166 of the distribution member 160 is formed to extend to both sides in the left and right direction and thus it is difficult to process by using a general flat plate. However, as in the embodiment of the present disclosure, the distribution member 160 may be easily processed in a method in which the two members 160*a* and 160*b* are coupled to each other, thereby improving the workability.

The supporter 166 may be fixed in the left-right direction while fixing the distribution member 160 in the vertical direction. The supporter 166 is disposed in the header 100 extending in the left-right direction of the heat exchanger 1 as described above, and thus the supporter 166 may support the distribution member 160 such that the distribution member 160 may be disposed at a predetermined position in the left and right direction within the header 100.

Figure 9:
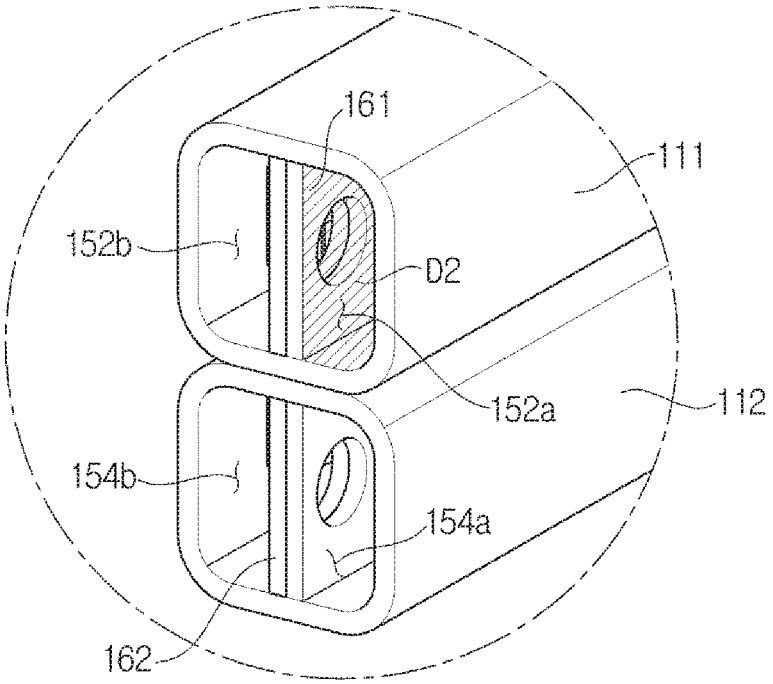
FIG. 9 is a cross-sectional perspective view taken along line AA shown in FIG. 3.
Figure 10:
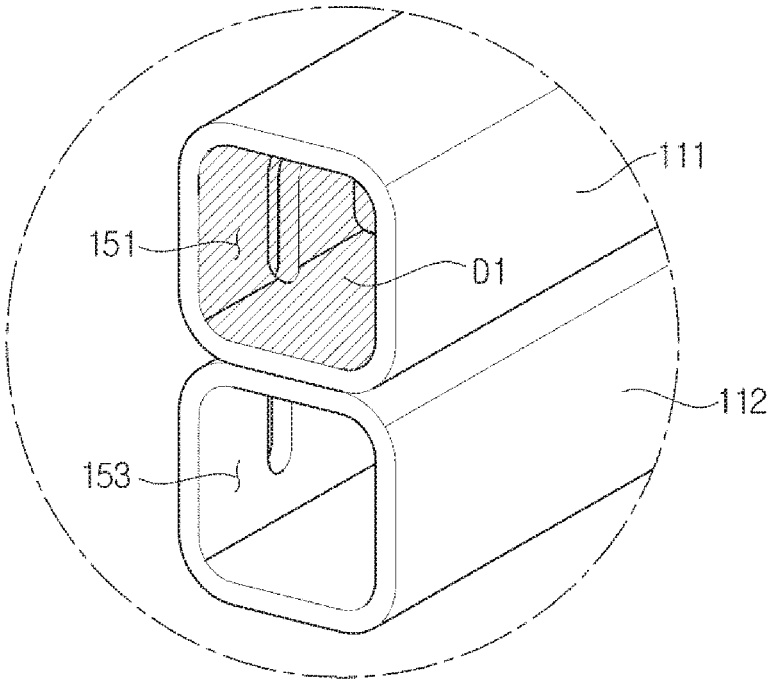
FIG. 10 a cross-sectional perspective view taken along line BB shown in FIG. 3.

As shown in FIGS. 9 and 10, when an inner cross sectional area of the header 100 is denoted by D1 and an inner cross sectional area of the refrigerant distribution portions 152*a*, 154*a*, 155*a* and 157*a* formed by the distribution member 160 is denoted by D2 respectively, the supporter 166 may support the distribution member 160 such that a ratio of a value of D2/D1 is approximately 35 to 45. This may be a desirable value to minimize the increase in refrigerant resistance while the refrigerant is evenly distributed to the respective tubes 10 when distributing the refrigerant to the plurality of tubes 10 through the refrigerant distribution portions 152*a*, 154*a*, 155*a*, and 157*a*. This value may be considered by the internal pressure of the refrigerant formed inside the refrigerant distribution portions 152*a*, 154*a*, 155*a*, and 157*a*.

Furthermore, as shown in FIG. 7, when the sum of the cross sections of the distribution holes 165 is denoted by D3, the size of the distribution hole 165 may be set such that a ratio of a value of D3/D1 is approximately 20 to 40. This may be a desirable value to minimize the increase in refrigerant resistance as the refrigerant is evenly distributed to the respective tubes when distributing the refrigerant through the distribution holes 165 to the plurality of tubes 10.

Hereinafter, the heat exchanger fin 200 will be described in detail.

Figure 11:
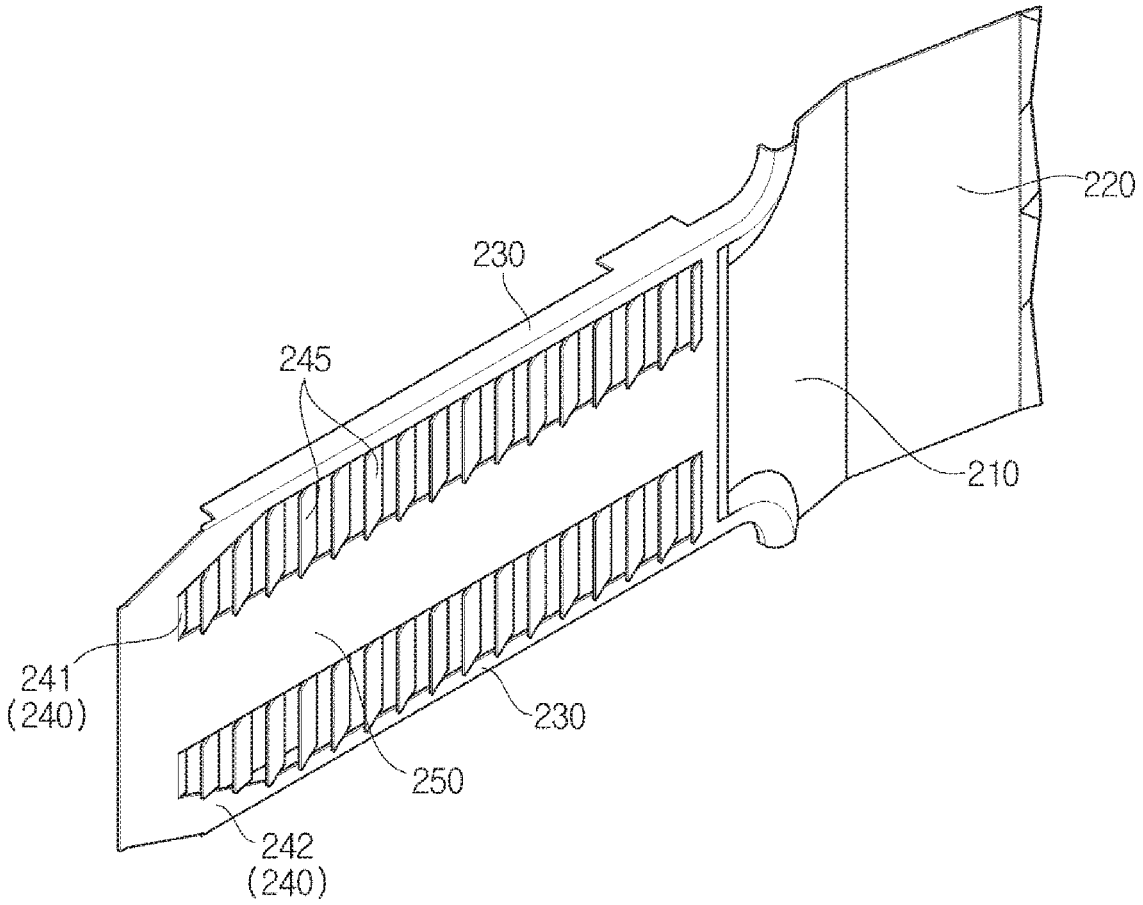
FIG. 11 is a perspective view of a portion of a heat exchanger fin according to an embodiment of the present disclosure.

As shown in FIGS. 2 and 11, the heat exchanger fin 200 is integrally formed in a wavy shape so as to be wrinkled, and is disposed in the longitudinal direction of the plurality of tubes 10 between upper and lower intervals of the plurality of tubes 10. The heat exchanger fin 200 may be in contact with both the plurality of tubes in the first row 11 and the plurality of tubes in the second row 12. The heat exchanger fin 200 may be brazed to the plurality of tubes 10.

The heat exchanger fin 200 may include a body 210 extending in the front and rear direction in which the plurality of tubes 10 is disposed, and a contact portion 230 in contact with the plurality of tubes 10 on upper and lower sides of the body 210.

The body 210 may be provided in a plurality of number so as to be spaced apart from each other in the left-right direction in which the plurality of tubes 10 extend. A rear part of the body 210 may be provided with a connection portion 220 to which a plurality of bodies 210 are connected. The body 210 may be formed with a louver portion 240 including a plurality of louvers 245 formed continuously in the longitudinal direction to improve heat transfer performance.

In the conventional heat exchanger fin of the heat exchanger, the louver section is provided on the entire body to improve the heat transfer performance of the heat exchanger fin. When the outside air is guided by the louver section and heat exchanged with the heat exchanger, the condensed water formed on the surface of the heat exchanger fin becomes frosted condition by the outside air. Frost starts to be conceived on the louver section and frost is formed on the louver section. So the flow path of the outside air was restricted and the heat transfer performance was deteriorated.

The heat exchanger fin 200 according to an embodiment of the present disclosure has a frost formed in the louver portion 240 under frosting condition and secures the flow path of the outside air even if frost grows in the louver portion 250 as time passes by a flat portion 250, so performance may be maintained. In detail, the flat portion 250 extending in the front-rear direction and formed in a plane may be provided on the center side of the body 210 in the up-and-down direction.

A first louver portion 251 formed of a plurality of louvers 245 is provided on the upper side of the flat portion 250 and a second louver portion 252 formed by a plurality of louvers 245 is provided below the flat portion 250.

Figure 12:
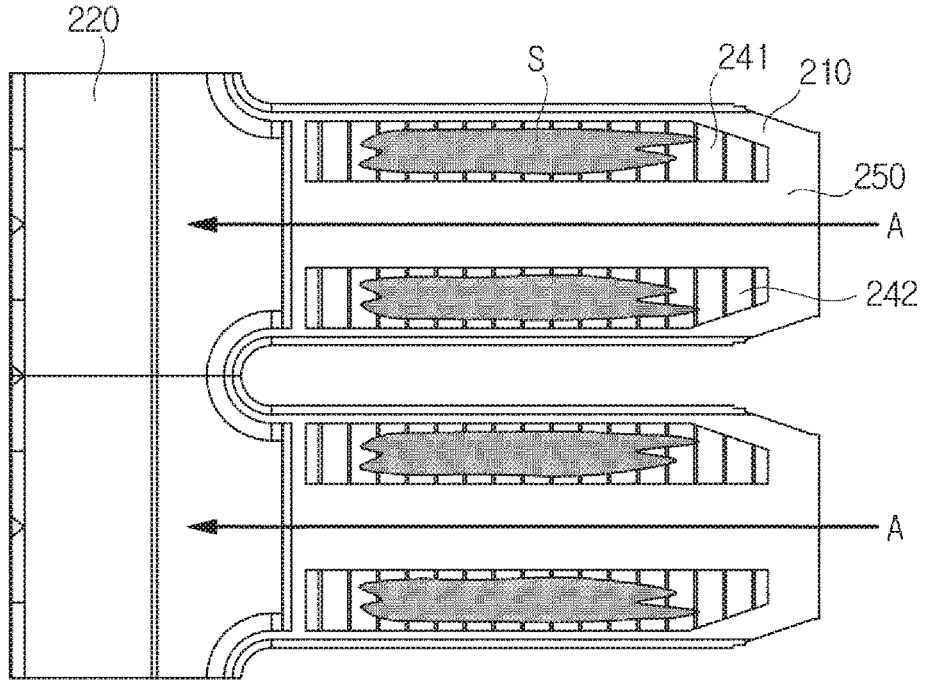
FIG. 12 is a view schematically showing a frost of the heat exchanger fin according to an embodiment of the present disclosure.

As shown in FIG. 12, the louver portion 240 is not provided on the entire body 210 of the heat exchanger fin 200, and the flat portion 250 is disposed between the louver portions 241 and 242, so that even if the frost S is formed on the louver portions 241 and 242, the air A flows along the flat portion 250 and the plurality of tubes 10 are still heat-exchanging because the flat portion 250 is provided to be a region where the frost is not grown under the frozen condition.

As the frost grows, the frost may eventually form on the flat portion 250 after a certain amount of time, but the heat transfer performance of the heat exchanger may be ensured by delaying the time for the frost to grow.

Figure 13:
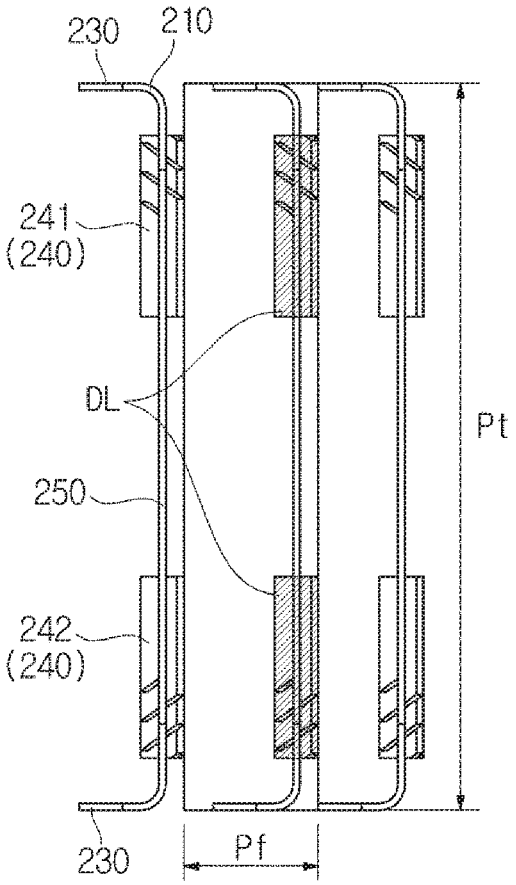
FIG. 13 is a front view of a part of the heat exchanger fin according to an embodiment of the present disclosure.

As shown in FIG. 13, a length in the vertical direction of the body 210, or the distance between the tubes 10 that are vertically offset from the plurality of tubes 10 is Pt, spacing distance between the adjacent body 210 in the plurality of body 210 spaced from each other in the left-right direction is Pf, and the sum of the cross sectional areas of the regions where the louver portions 240 are formed on the front face is DL, the louver portion 240 may be formed so that the a ratio of a value of DL/(Pt*Pf) is 24 or less.

That is, it is appropriate that the front cross sectional area ratio of the louver portion 240 is set to 24% or less of (Pt*Pf). If the ratio of D3 is formed to be 24% or more, the heat transfer performance is improved by the louver portion 240, but the width of the improvement of the ventilation resistance is increased. Thus, in comparison with the conventional general heat exchanger fins (heat exchanger fins having louver portions formed on the entire body), performance may be rather low. In contrast, when the ratio of D3 is 24% or less, the heat transfer performance may be improved compared with the conventional heat exchanger fins.

Figure 14:
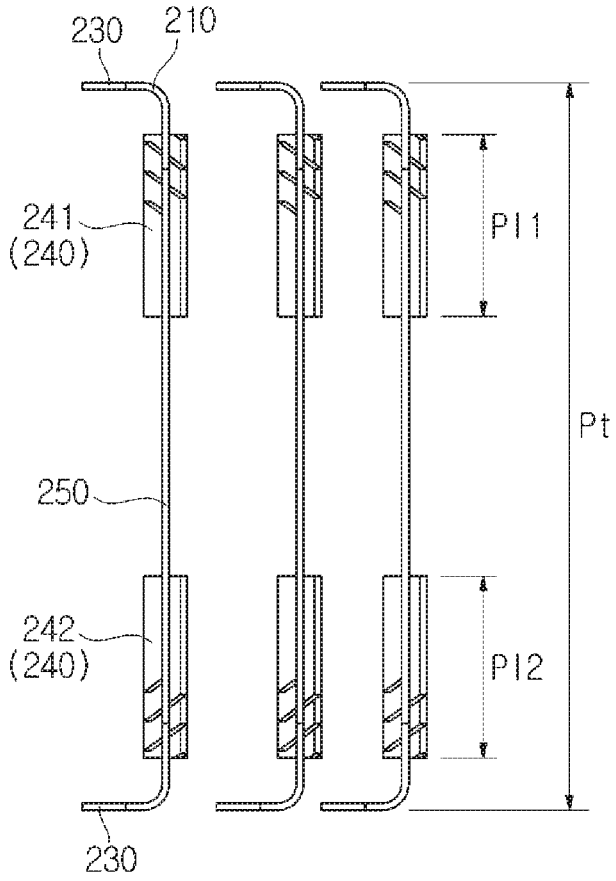
FIG. 14 is a front view of a part of the heat exchanger fin according to an embodiment of the present disclosure.

As shown in FIG. 14, the length of the body 210 in the up-and-down direction or the interval between the tubes 10 that are vertically offset from the plurality of tubes 10 is Pt, the length of the region in which the first louver portion 241 is formed in the vertical direction is P11, and the length of the region where the second louver portion 242 is formed is P12, then the louver portion 240 may be formed such that a ratio of a value of (P11+P12)/Pt is 65 or less.

That is, the sum of the lengths of the louver portions 240 in the up and down direction is appropriately set to 65% or less of Pt. If the sum of the lengths of the louver portions 240 in the up and down direction is more than 65%, the heat transfer performance is improved by the louver portion 240, but the width of the improvement of the ventilation resistance is increased, so the heat transfer performance may be lowered as compared with the heat exchanger fins having the louver portions formed on the entire body. Alternatively, if the sum of the lengths of the louver portions 240 in the up and down direction is 65% or less, the heat transfer performance may be improved compared with the conventional heat exchanger fins.

Hereinafter, a heat exchanger fin 200 according to another embodiment of the present disclosure will be described. The configurations other than the configuration of the louver portion 240 and the flat portion 250 described below are the same as those of the above-described embodiment of the present disclosure, and a duplicate description will be omitted.

Figure 15:
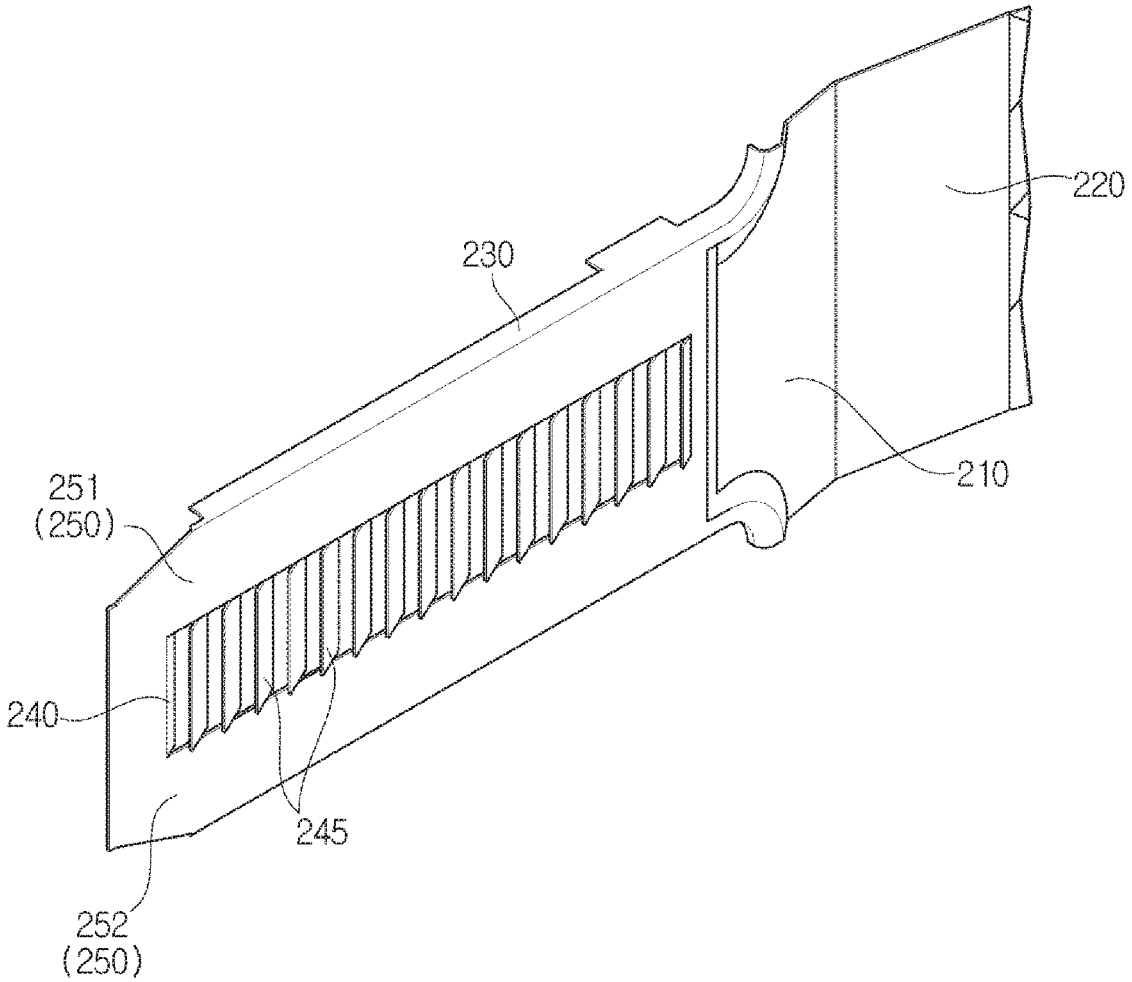
FIG. 15 is a perspective view of a part of a heat exchanger fin according to another embodiment of the present disclosure.

As shown in FIG. 15, a louver portion 240 including a plurality of louvers 245 may be provided on the center of the body 210 in the vertical direction. A plurality of louvers 245 are not formed on the upper side or lower side of the louver portion 240. The flat portion 250 includes a first flat portion 251 formed in a plane shape without the plurality of louvers 245 and formed on the upper side of the louver portion 240, and a second flat portion 252 formed in a plane shape without the plurality of louvers 245 and formed on the lower side of the louver portion 240.

Figure 16:
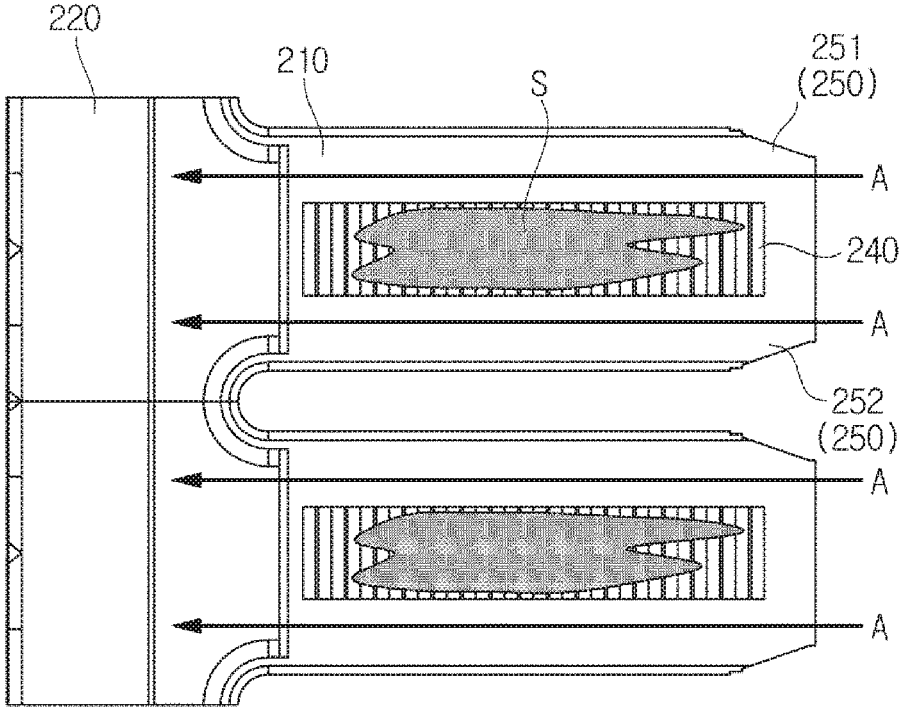
FIG. 16 is a view schematically showing a frost in the heat exchanger fin according to another embodiment of the present disclosure.

So, as shown in FIG. 16, even if the frost S is formed on the louver portion 240, the flow path of the outside air A may be ensured by the first flat portion 251 and the second flat portion 252 provided in the vertical direction of the louver portion 240 and the growth of the frost may be delayed.

The heat exchanger 1 described above may be used as the condenser or the evaporator by a refrigerant cycle. According to the embodiment of the present disclosure, the heat exchanger 1 is described according to the flow of the refrigerant under the evaporation condition, but the same effect as the above-described effect may be obtained even under the condensing condition of the heat exchanger 1. The refrigerant flows in the opposite direction to the description. However, the refrigerant flows into the heat exchanger 1 through the outlet pipe 280, not through the inlet pipe 270, and flows out of the heat exchanger 1 through the inlet pipe 270, which is that the refrigerant flows in the opposite direction to the description above.

The refrigerant is heat-exchanged while flowing through the plurality of tubes 10 divided into four areas, and the distribution member 160 is provided at the introduction portion side of each area, the refrigerant may be uniformly distributed even the refrigerant flows in the opposite direction.

The heat exchanger of the present disclosure divides a plurality of tubes into four areas to secure the flow length of the refrigerant, and the distribution member is disposed in the refrigerant introduction portion into which the refrigerant flows in the four areas to equalize the inflow of the refrigerant to improve the heat exchange performance.

According to the heat exchanger of the present disclosure, a louver portion formed of a plurality of louvers protruding to the outside of the heat exchanger fin and a plate portion formed in a flat shape are disposed in the body of the heat exchanger fin, and the frosting is delayed in the louver portion to improve the heat exchange performance.

The present disclosure is not limited to the above-described embodiments, and it should be clear to those skilled in the art that various modifications and changes may be made without departing from the scope of the present disclosure. Therefore, modified or changed embodiments are included in the range of the claims of the present disclosure.

What is claimed is:

1. A heat exchanger comprising:

a plurality of tubes arranged in a first row and a second row;

a first header connected to one end of the plurality of the first row tubes and a second header connected to one end of the plurality of the second row tubes;

a first baffle dividing an inside of the first header into a first channel and a second channel in a vertical direction and dividing an inside of the second header into a third channel and a fourth channel in a vertical direction;

a first distribution member configured to distribute refrigerant and dividing an inside of the second channel into a first refrigerant distribution portion and a first refrigerant introduction portion;

a third header connected to an opposite end of the plurality of the first row tubes from the one end connected to the first header;

a second baffle dividing an inside of the third header into a fifth channel and a sixth channel in the vertical direction and having a short length allowing refrigerant to flow from the sixth channel into the fifth channel;

an inlet pipe connected to the second channel to allow the refrigerant to flow therein; and an outlet pipe connected to the third channel to discharge the refrigerant, wherein the plurality of tubes in the first row comprises a first area and a second area that are vertically partitioned through the first baffle and have opposite refrigerant flow directions, wherein the plurality of tubes in the second row comprises a third area and a fourth area that are vertically partitioned through the first baffle and have opposite refrigerant flow directions, and wherein the second area connected to the first channel and the fourth area connected to the third channel have a same refrigerant flow direction.

2. The heat exchanger of claim 1, further comprising a fourth header connected to an opposite end of the plurality of the second row tubes, wherein the second baffle further divides an inside of the fourth header into a seventh channel and an eighth channel in the vertical direction.

3. The heat exchanger of claim 2, wherein refrigerant flowing into the first header through the inlet pipe flows:

to the third header sequentially through the second channel, the first area and the sixth channel, upward to the fifth channel from the sixth channel, and back to the first header sequentially through the fifth channel, the second area and the first channel.

4. The heat exchanger of claim 3, further comprising a connecting pipe connecting the first channel and the fourth channel, wherein the refrigerant in the first channel flows into the fourth channel through the connecting pipe.

5. The heat exchanger of claim 4, wherein the refrigerant flowing into the second header through the connecting pipe flows through the fourth channel, the third area, and the eighth channel sequentially to the fourth header, and flows upward from the eighth channel, and flows back through the seventh channel, the fourth area, and the third channel sequentially to the second header, and then flows to the outlet pipe.

6. The heat exchanger of claim 2, further comprising: a second distribution member dividing an inside of the fifth channel into a second refrigerant distribution portion and a second refrigerant introduction portion, a third distribution member dividing an inside of the sixth channel into a third refrigerant distribution portion and a third refrigerant introduction portion, and a fourth distribution member dividing an inside of the seventh channel into a fourth refrigerant distribution portion and a fourth refrigerant introduction portion.

7. The heat exchanger of claim 6, wherein a cross-sectional area ratio of the first refrigerant distribution portion and the second channel in an upward and downward direction is in a range of 35% to 45%.

8. The heat exchanger of claim 6, wherein the first distribution member comprises two or more distribution holes allowing the refrigerant to flow from the first refrigerant distribution portion to the first refrigerant introduction portion, and a ratio of a value of total amount of cross-sectional area of the distribution hole in a forward and backward direction and a ratio of a value of total amount of cross-sectional area of the second channel in an upward and downward direction is in a range of 20% to 40%.

9. The heat exchanger of claim 6, wherein the second baffle is configured to respectively divide the third header and the fourth header such that the fifth channel communicates with the sixth channel inside of the third header and the seventh channel communicates with the eighth channel inside of the fourth header.

10. The heat exchanger of claim 6, wherein the first distribution member comprises a distribution portion extending in a longitudinal direction of the second channel and a support portion provided at both ends of the distribution portion and extending in a left-right direction of the second channel.

11. The heat exchanger of claim 1, further comprising a heat exchanger fin having a body extending in a second row direction from the first row and disposed between the plurality of tubes to come into contact with the plurality of tubes, wherein the body comprises a louver area in which a plurality of louvers projecting from the body is disposed and a plate area extending in the second row direction from the first row and having a flat surface.

12. The heat exchanger of claim 11, wherein the louver area comprises a first louver area disposed above the plate area and a second louver area disposed below the plate area.

13. The heat exchanger of claim 11, wherein the plate area comprises a first plate area disposed on an upper side of the louver area and a second plate area disposed on a lower side of the louver area.

14. The heat exchanger of claim 11, wherein a length of the louver area in an upward and downward direction is 65% or less of a length of the body in the upward and downward direction.

15. The heat exchanger of claim 11, wherein the body comprises a first body and a second body disposed apart from each other in an extending direction of the plurality of tubes, and a ratio of a value of multiplying a distance between the first body and the second body by a length of the first body in the vertical direction and a value of cross-sectional area in a forward and backward direction of the heat exchanger fin of the first body is less than 24%.

16. A heat exchanger comprising:

a plurality of tubes arranged in a first row and a second row;

a pair of first headers connected to one end of the plurality of the first row tubes and one end of the plurality of the second row tubes respectively, wherein a first front row header of the pair of first headers is connected to a refrigerant inlet pipe and a first rear row header of the pair of first header is connected to a refrigerant outlet pipe;

a pair of second headers connected to the opposite end of the plurality of the first row tubes and the opposite end of the plurality of the second row tubes respectively;

a first baffle dividing an inner space of the pair of the first headers in a longitudinal direction of the pair of first headers;

a second baffle dividing an inner space of the pair of second headers in the longitudinal direction of the pair of second headers, wherein the refrigerant flowing through the refrigerant inlet pipe flows into four areas divided in the plurality of tubes by the first and second baffles and then flows into the refrigerant outlet pipe; and four distribution members configured to distribute the refrigerant flowing through the four areas that are respectively mounted on four refrigerant introduction portions.

17. The heat exchanger of claim 16, wherein two of the four distribution members disposed in the pair of first headers are disposed below the first baffle and another two distribution members disposed in the pair of second headers are disposed above the second baffle.

18. The heat exchanger of claim 17, wherein the pair of first headers comprises the first front row header disposed at the first row of the plurality of tubes and the first rear row header disposed at the second row of the plurality of tubes, a connection pipe is disposed between the first front row header and the first rear row header, and the refrigerant having passed through two of the four areas arranged in the first row of the plurality of tubes passes through two of the four areas arranged in the second row of the plurality of tubes through the connecting pipe.

19. The heat exchanger of claim 16, further comprising a pair of third baffles dividing the inside of the pair of first headers and respectively disposed on upper and lower sides of the first baffle, and a pair of fourth baffles dividing the inside of the pair of the second headers and respectively disposed on the upper and lower sides of the first baffle, and wherein the four distribution members are respectively disposed in four spaces formed by the first baffle, the second baffle, the pair of the third baffles and the pair of the fourth baffles.

20. A heat exchanger comprising:

a plurality of tubes arranged in a first row and a second row;

four headers respectively connected to opposite ends of the first row and the second row of the plurality of tubes and extending in a vertical direction;

two baffles dividing an inner space in a longitudinal direction of the four headers, wherein one of the two baffles has a short length allowing refrigerant to flow from the between channels created by the one baffle in two of the four headers;

a first distribution member configured to distribute refrigerant and dividing an inside of a second channel, created in a header by one of the two baffles, into a first refrigerant distribution portion and a first refrigerant introduction portion; and a heat exchanger fin having a body extending in a second row direction from the first row arranged between the plurality of tubes to come into to contact with the plurality of tubes, wherein the refrigerant is redirected at least three times by the two baffles while flowing inside the plurality of tubes, and wherein the body comprises a louver area in which a plurality of louvers projecting on the body is disposed and a plate area extending in the second row direction from the first row at a central portion of the louver area and having a flat surface.

* * * * *